US007055264B2

(12) United States Patent
Gallegos

(10) Patent No.: US 7,055,264 B2
(45) Date of Patent: Jun. 6, 2006

(54) VENTILATING FOOTWEAR AND METHOD OF VENTILATING FOOTWEAR

(76) Inventor: Alvaro Z. Gallegos, 6932 4th St. North West, Albuquerque, NM (US) 87107

( * ) Notice: Subject to any disclaimer, the term of this patent is extended or adjusted under 35 U.S.C. 154(b) by 0 days.

(21) Appl. No.: 10/202,796

(22) Filed: Jul. 25, 2002

(65) Prior Publication Data

US 2004/0016144 A1 Jan. 29, 2004

(51) Int. Cl.
*A43B 13/28* (2006.01)

(52) U.S. Cl. ..... 36/3 B; 36/3 R; 36/27; 36/28; 36/35 R; 36/35 B

(58) Field of Classification Search ..... 36/3 R, 36/3 B, 38, 27, 28, 29, 37, 35 R, 35 B
See application file for complete search history.

(56) References Cited

U.S. PATENT DOCUMENTS

| | | | | | |
|---|---|---|---|---|---|
| 479,805 | A | * | 8/1892 | Helbach | 36/3 R |
| 622,673 | A | * | 4/1899 | Ferrata | 36/3 B |
| 1,159,758 | A | * | 11/1915 | Gambino | 36/3 R |
| 1,328,816 | A | * | 1/1920 | Brown | 36/38 |
| 1,369,590 | A | * | 2/1921 | Voltolini | 36/3 R |
| 1,510,841 | A | * | 10/1924 | Hanley | 36/38 |
| 1,750,970 | A | * | 3/1930 | Schwalm | 36/3 R |
| 1,870,065 | A | * | 8/1932 | Nusser | 36/38 |
| 2,078,551 | A | * | 4/1937 | Williams | 36/38 |
| 2,086,790 | A | * | 7/1937 | Wroten | 36/3 R |
| 2,104,924 | A | * | 1/1938 | Dellea | 36/38 |
| 2,444,865 | A | * | 7/1948 | Warrington | 36/38 |
| 2,669,038 | A | * | 2/1954 | De Werth | 36/38 |
| 3,670,429 | A | * | 6/1972 | Androsiglio | 36/3 B |
| 4,343,097 | A | * | 8/1982 | Sasaki | 36/3 A |
| 4,590,689 | A | | 5/1986 | Rosenberg | |
| 4,760,651 | A | | 8/1988 | Pon-Tzu | |
| 5,435,079 | A | * | 7/1995 | Gallegos | 36/38 |
| 5,511,324 | A | * | 4/1996 | Smith | 36/27 |
| 5,619,809 | A | | 4/1997 | Sessa | |
| 5,697,171 | A | * | 12/1997 | Phillips | 36/3 B |
| 5,970,630 | A | | 10/1999 | Gallegos | |
| 6,205,680 | B1 | | 3/2001 | Clark | |

OTHER PUBLICATIONS

U.S. Appl. No. 09/727,677, filed Apr. 19, 2001, Attilieni.

* cited by examiner

*Primary Examiner*—Marie Patterson
(74) *Attorney, Agent, or Firm*—Kenneth L. Nash

(57) ABSTRACT

Ventilating footwear provides air circulation under and around the foot. Apertures in the heel and/or sole and/or midsole communicate with an air compartment in the heel and/or sole and/or midsole, and as the wearer strides, the heel and/or sole and/or midsole are compressed, expelling the air from the compartment and into the footwear upper. The top side surface of the sole or midsole may also be provided with a plurality of air channels which direct and circulate air from the compartment around and underneath the wearer's foot. The footwear may also provide shock absorbence and energy return through the compressible heel and/or sole and/or midsole, and may have a rigid or semi-rigid midsole, which provides support, as well as cushioning below the midsole for comfort.

37 Claims, 7 Drawing Sheets

VENTILATING FOOTWEAR AND METHOD OF VENTILATING FOOTWEAR

TECHNICAL FIELD

The present invention relates to footwear, and more particularly to footwear which is ventilating and has air flow and transfer within the footwear, yet also provides support to the foot as well as shock absorbence. The present invention also relates to a method of ventilating footwear.

BACKGROUND OF THE INVENTION

Footwear manufacturers continually work to improve the comfort of their products. One way is to provide footwear which support the wearer's foot and which has shock absorbing capabilities. Another way for improving the comfort of conventional footwear is to provide a system for ventilation or circulation into the upper and around the foot. Air circulation prevents stagnant air from being trapped around the foot where it can retain heat and moisture which make the footwear uncomfortable and provide a breeding-ground for bacteria.

The present invention relates to footwear having a plurality of apertures in the sole or midsole, preferably in conjunction with air channels on the surface of the sole, midsole and/or insole, and a heel and/or sole or midsole with at least one air chamber located within the heel cavity and a support member therein which compresses and returns to an expanded position. The cavities, especially in the heel, provide a relatively large chamber for the displacement and transfer of air into the upper. The heel cavities and/or the sole or midsole cavities are compressible and have a support member located therein which is also compressible. The support member(s) provide the footwear with a trampoline-like and controlled resiliency, over a range of loads. In conjunction with the air transfer, ventilation, and circulation system, the present invention also includes a sole and/or midsole which provides superior support, yet has shock absorbing capabilities which lessen the stress upon the joints and foot. The rigid or semirigid sole or midsole may also be combined with an orthotic which provides enhanced support and comfort.

The present inventor has found that conventional shoes lack the foregoing features and that they are therefore defective. As such, the inventor has invented the present footwear which includes such features.

DETAILED DESCRIPTION OF THE PREFERRED EMBODIMENT

Figure 1:
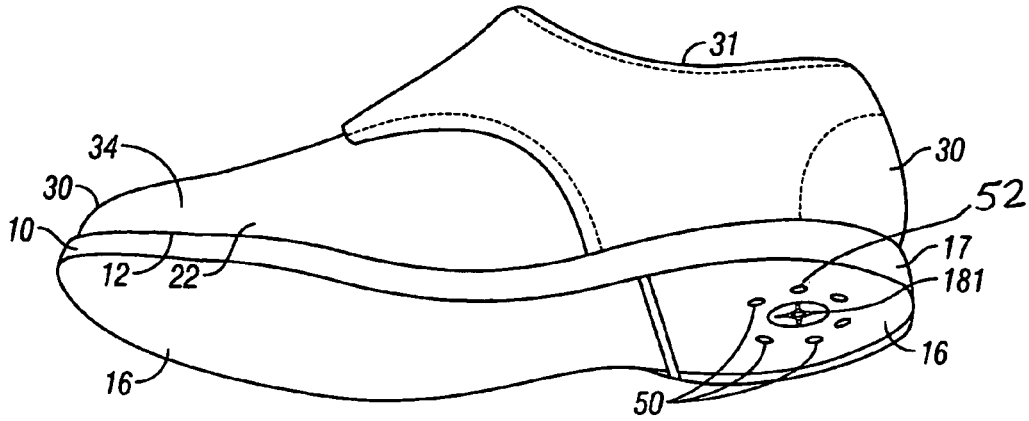
FIG. 1 is a perspective view of the underside and upper of the footwear.
Figure 7:
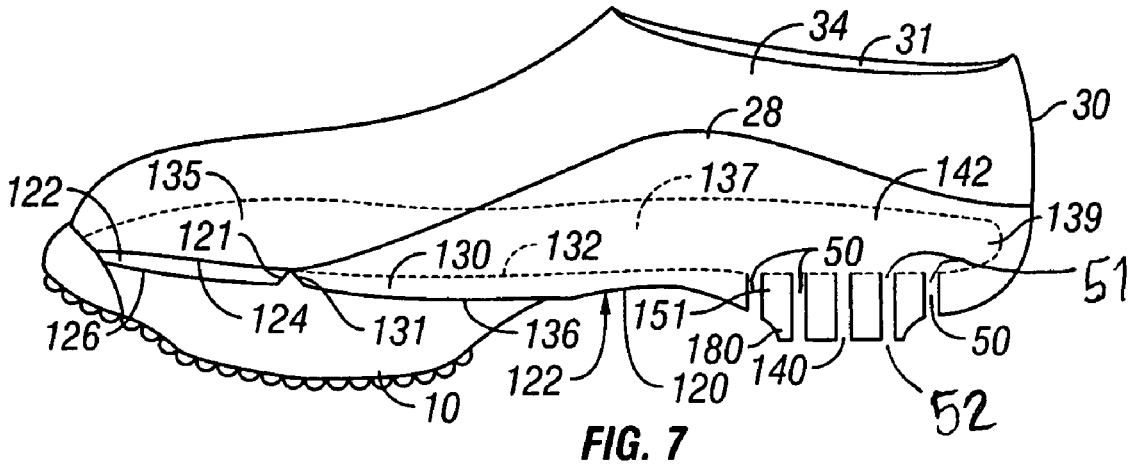
FIG. 7 is a side view of footwear with a midsole, a built-in orthotic, outsole cushioning, and apertures within the midsole.
Figure 14:
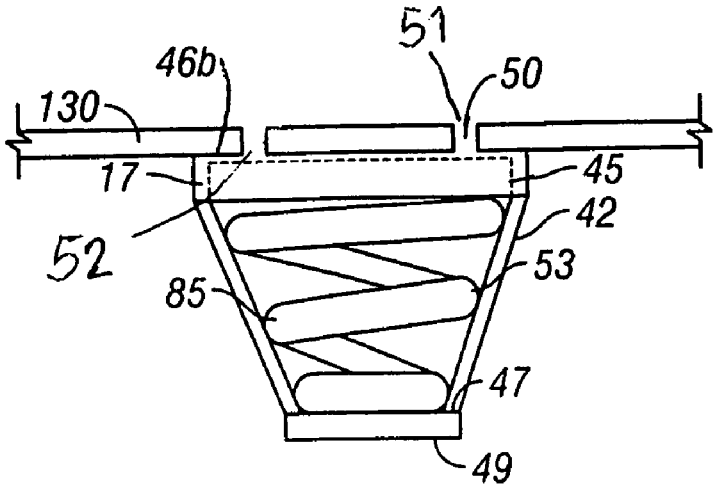
FIG. 14 is a side view of a dress shoe heel with sidewalls and a support member.
Figure 15:
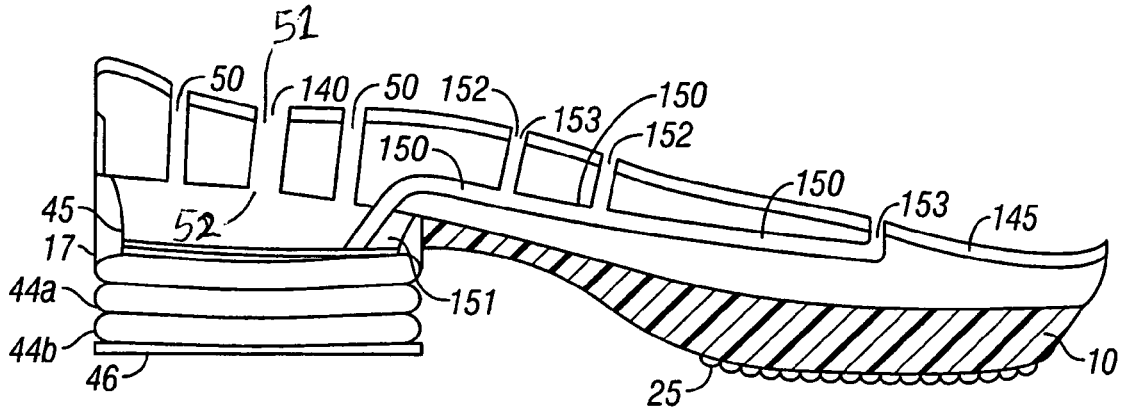
FIG. 15 is a side view of a sole and midsole with apertures, ducts, and vents.
Figure 16:
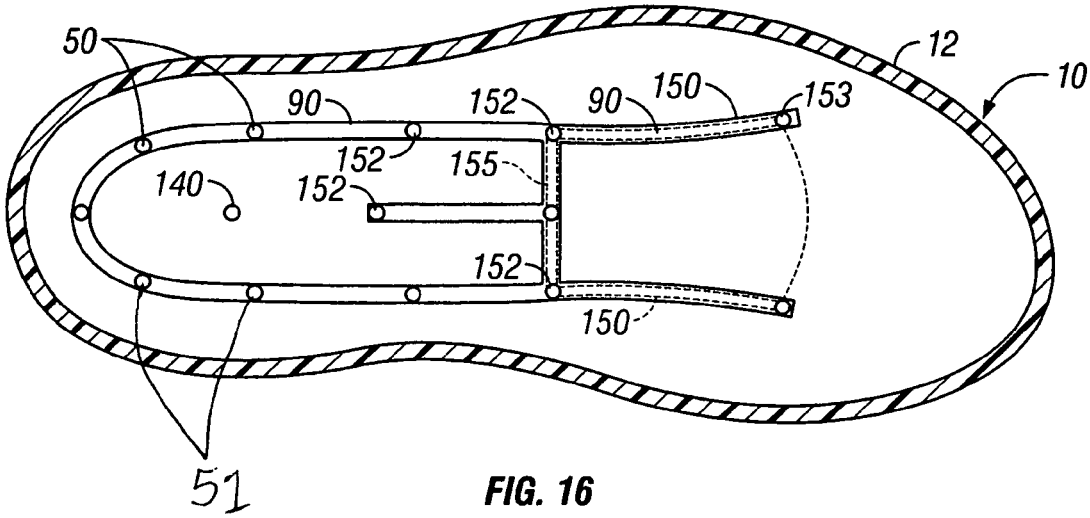
FIG. 16 is a top view of a sole and midsole with apertures, ducts, and vents, and channels.
Figure 17:
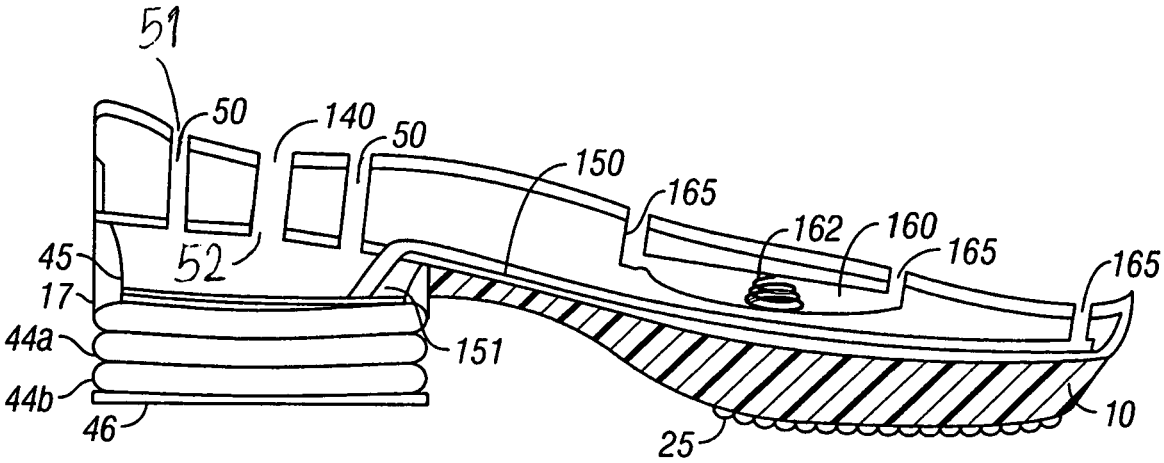
FIG. 17 is a side view of a sole and midsole with apertures, an air chamber with openings into the upper.
Figure 18:
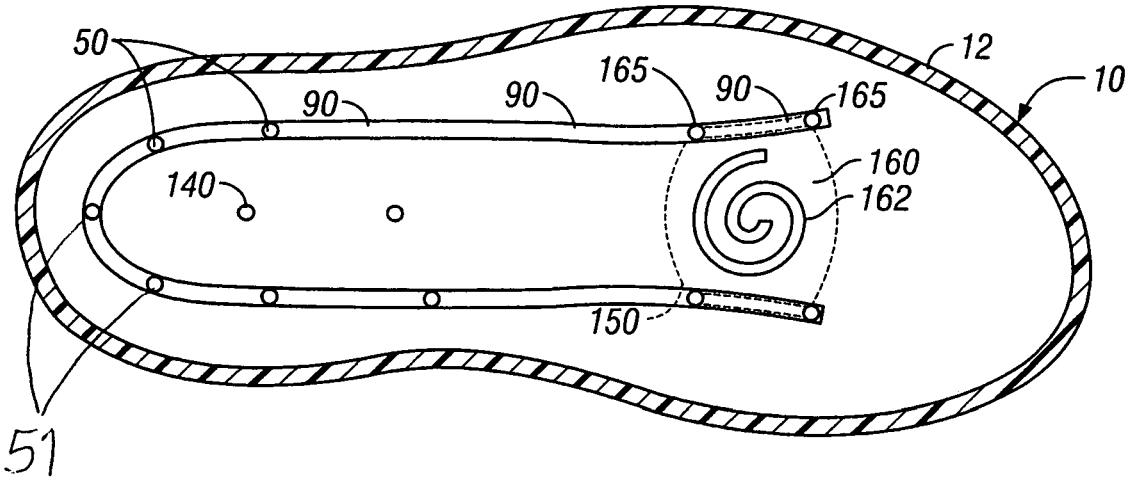
FIG. 18 is a top view of a sole and midsole with apertures, an air chamber with openings into the upper, and channels.

Several variations of ventilated footwear are illustrated in FIGS. 1–18. As shown in FIG. 1, one variation of the footwear has a sole 10 with has a top side 12, a bottom side 16 which may serve as the wear surface of the sole 10. The footwear has an upper 30 having an inside 31 and an outside 34. The style of the upper 30 and the manner of securing it to the sole 10 will vary depending on the design of the footwear. The upper 30 includes all types of footwear, and the invention is especially advantageous in closed footwear such as athletic shoes, work boots, hiking boots, etc. The upper 30 may be construction of any type of material such as canvas, leather, synthetic leather, vinyl, plastic, etc., or a combination thereof, and any other materials known to or used by one of ordinary skill in the art. FIGS. 1, 7. The upper 30 may also have a plurality of holes 35 within the body of the upper 30, preferably near the top of the upper, which also provide air ventilation. The upper 30 is secured to the margin 24 of the sole using conventional techniques such as gluing, but it could also be stitched and/or attached by adhesives. Alternatively, the upper 30 may be removably attached to the sole 10 and/or midsole 120 such as by a stud and aperture connection, Velcro®, i.e., mated hooks and loops, fasteners, adhesives, magnets, a wedge and aperture connection, a screw, a bolt, a hinge, a staple, a nut, studs, snaps, wedges and a combination thereof, to allow replacement or interchanging of the soles 10 and/or midsoles 120. The footwear also has a heel 40 which may be removably or securably attached to the sole 10 and is intended for use with a wide variety of conventional uppers allowing it to be incorporated into a variety of footwear such as athletic shoes, high heels, boots, sandals and other soled footwear. E.g., FIGS. 2–4, 6 8, 10–11, 14. FIG. 14 shows a heel which can be used with ladies' dress shoes, and which may also have telescoping sidewalls (not shown). The heel 40 has sidewalls 43, which have inside walls and outside walls 44, and a bottom plate 46 which has an inner surface 47 and an outer surface 49 which is also a wear surface.

The footwear also has a plurality of apertures 50 which are defined in the 10 sole and/or midsole 120 and which extend through the top side 12 and bottom side 16 of the sole or midsole, and which allow air to flow into and out of the air compartment 110 in the heel 40. See FIGS. 1–4, 8, 10–11, 14, 15, 17. In an embodiment, each aperture has an opening 51 on the top side 12 of the sole and/or midsole and an opening 52 on the bottom side 16 of the sole and/or midsole. See FIGS. 1, 5, 6. 7, 8, 9, 14, 15, 16, 17, and 18. As shown in FIGS. 1–4, 8, 10, 14, 15, 17, the heel 40 contains or houses at least one air compartment 110 within the heel, and the air compartment 110 is connected to or communicates with the apertures 50 in the sole, and in some embodiments in the sole or midsole. See FIGS. 15–18. The heel 40 also contains at least one support member which is typically a spring or spring-like and which compresses and recovers to an expanded position. With the exception of the support member such as a spring 86, the majority of the inside of the heel 40 may be devoid of any supporting material and may comprise empty space which holds a relatively large volume of air. During walking, the force of the body weight compresses the heel 40 and the support member 85, which decreases the volume of the air compartment 110 and expels or forces air from the air compartment 110 upwardly through the apertures 50, 50 in the sole 10 and into the upper 30 of the footwear and under and around the wearer's foot. Conversely, as weight is lifted from the spring 85 or spring-like support member and heel 40 as the wearer's foot is lifted off the ground, the heel 40 expands to its uncompressed state and the volume of space in the air compartment 110 increases, thus causing low pressure which creates a vacuum within the heel 40. This draws air back downwardly through the apertures 50, 50 into the heel 40 and away from the wearer's foot. The pumping action of the heel 40 repeats with each stride and provides air ventilation to the inside 31 of the upper 30 of the footwear. Further the design and structure of this footwear, even upon a minimal or almost imperceptible rocking or compressive action which the wearer experiences when standing may also compress the heel 40 and air compartment 110, resulting in air being pumped up through the apertures 50 into the upper 30 of the footwear and down through the apertures 50 into the heel 40 and air compartment 110.

Besides having apertures 50 in the sole, the top side 12 of the sole 50 may be provided with one or more substantially horizontal air channels 90, or grooves, in the surface of the sole or midsole 120. See FIGS. 5, 16. If the channels 90 are present, the top side openings 51 of the apertures 50 are located within the channels 90, such that the channels 90 are in communication with the apertures and direct and circulate the air around and underneath the wearer's foot and away from the heel area 22 of the sole 10 into the more frontwardly areas of the footwear by the arch 20 and toe 18 area. See FIGS. 1, 5, 7, 16. Apertures 50, 50 alone may provide sufficient circulation to the areas of the upper 30, especially if they are located away from the weight bearing areas of the foot which is in contact with the top side 12 of the sole 10.

Returning now to footwear also having channels 90, the channels 90 may be arranged in a variety of configurations, taking into consideration of the location of the apertures 50, as well as the support and comfort function of the insole 145, sole 10 or midsole 120, or orthotic in mind. See e.g., FIGS. 5, 6, 9, 16, 18. In footwear having both apertures 50 and channels 90, when the force of the body weight compresses the heel 40 and the support member 85 and decreases the volume of the air compartment 110 which expels or forces air out of compartment 110 upwardly through the apertures 50, 50 in the sole 10 into the upper 30 of the footwear and under and around the wearer's foot, and into the channels 90 into the more frontwardly toe area 18 and arch area 20 of the footwear. Conversely, as the wearer's foot is lifted off the ground and force is lifted from the support member 85 and heel 40, the heel 40 expands to its uncompressed state thereby increasing the volume of space in the air compartment 110 which creates low pressure and a vacuum within the heel 40 which draws air back downwardly into the heel 40 through the apertures 50, 50 and channels 90 and away from the wearer's foot. As before, the air pumping action of the heel 40 repeats with each stride or rocking movement and provides air ventilation through apertures 50 and into the channels 90 and into the inside 31 of the upper 30 of the footwear.

Figure 8:
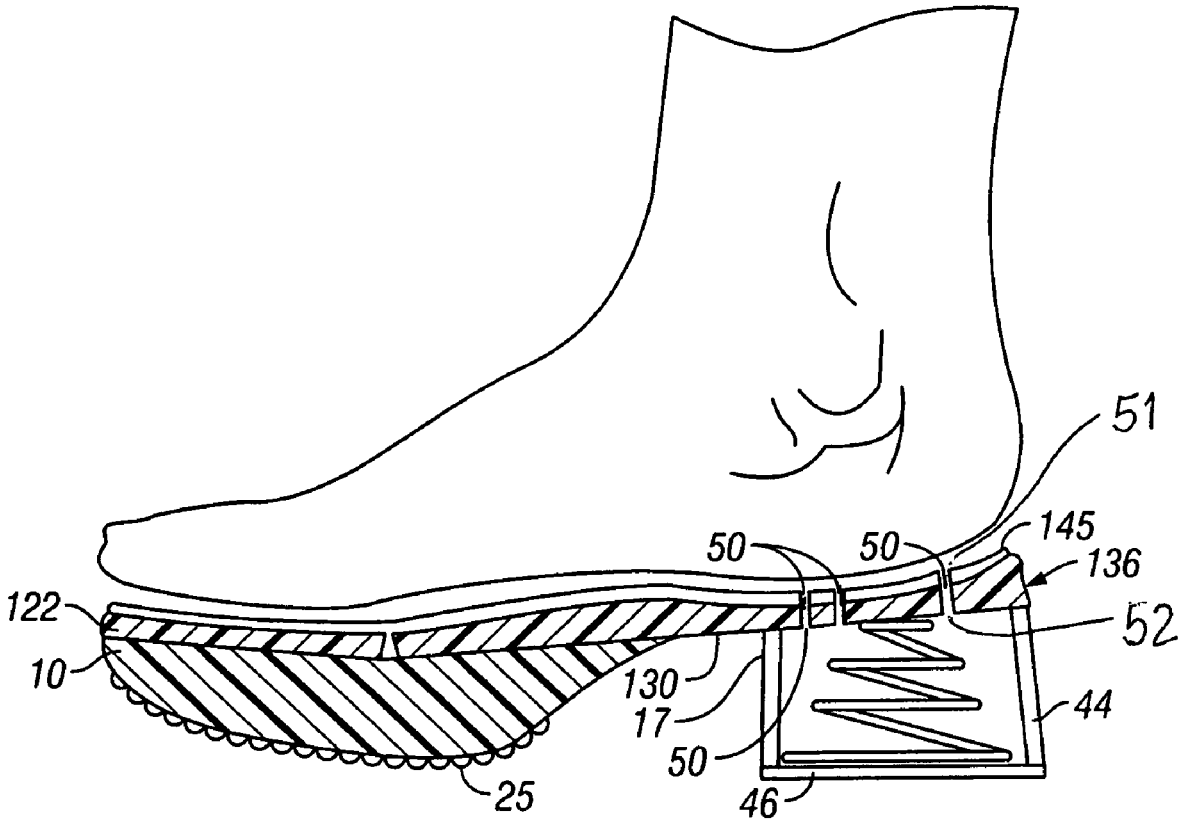
FIG. 8 is a side view of footwear with a multi-piece midsole, padding or cushioning beneath the midsole, an outsole, an insole and a heel with an enclosed support member.
Figure 9:
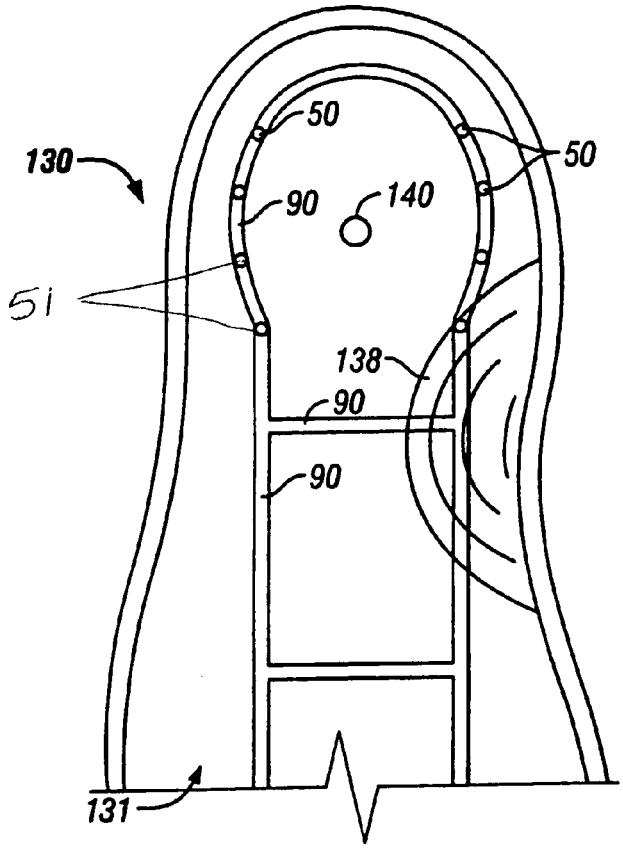
FIG. 9 is a top view of a midsole with apertures and venting channels.
Figure 10:
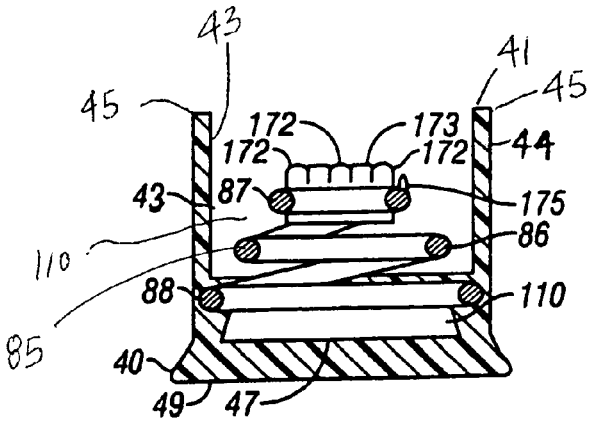
FIG. 10 is a side view of an unattached heel with a support member and mounting appliance.
Figure 11:
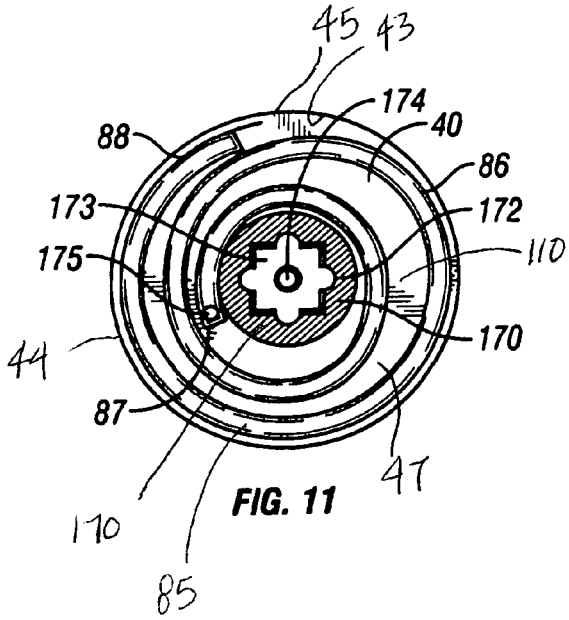
FIG. 11 is a top view of a support member with a mounting appliance.
Figure 12:
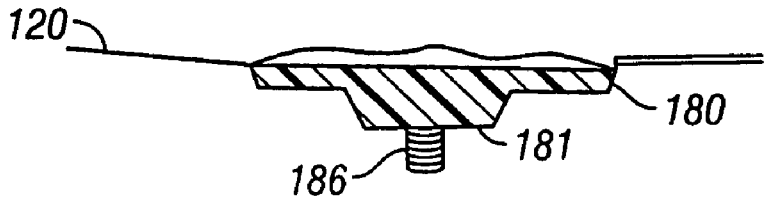
FIG. 12 is a side view of a mounting platform, spacer, and bolt.
Figure 13:
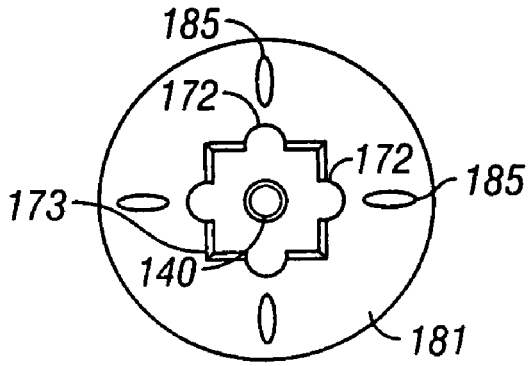
FIG. 13 is a bottom view of the spacer.

With respect to further details about the invention and the variations of the various embodiments, the footwear of this invention may have several types of soles 10 or midsoles 120 which range from rigid to flexible, to semi-flexible. Due to the fact that the heel 40 compresses and recovers to an expanded position, it may be preferable to have a sole 10 or midsole 120 which is rigid, semi-rigid, or has a semi-rigid or rigid portion. Further, the midsole may be formed of more than one piece, with for example, the second piece 130 being rigid with the end 131 of the second piece of the midsole forming a hinge-like area adjacent to the end 121 of the first piece 122, which is preferably flexible first portion 122. E.g. FIGS. 7,8. The rigid midsole 120 may be incorporated into a footwear of any type so as to extend from a metatarsal area of a wearer's foot, to the rearmost portion of the footwear generally proximate to the heel 40. Preferably, the midsole 120 is a generally or substantially planar piece, as shown in FIG. 8. However, the midsole 120 can also be combined with an orthotic and be molded to the shape of the foot and may have a raised arch surface 138, as shown in FIG. 9. An orthotic may also be placed above the sole 10 or the midsole 120.

A variation of the preferred embodiment may have a midsole 120, a layer of cushioning 13 or padding, and an undersole or outsole 25 therebeneath. See FIGS. 7–8, 15, 17. The cushioning layer 13 may be comprised of a variety of materials which provide cushioning such as gel, EVA, foam, sponge, a combination thereof, or other cushioning materials known or used by one skilled in the art. The cushioning layer 13 may also be removably attached to the midsole 120 such as by a stud and aperture connection, Velcro®, i.e., mated hooks and loops, fasteners, adhesives, magnets, a wedge and aperture connection, a screw, a bolt, a hinge, a staple, a nut, studs, snaps, wedges and a combination thereof or by other means known to one skilled in the art. In the embodiment having a rigid midsole 120, the midsole 120 preferably extends substantially from a metatarsal area of a wearer's foot to a rear area of the foot. In some cases, the midsole 120 extends at least approximately two-thirds of the total horizontal length of the foot as measured from a toe area of the foot to the rear area of the foot so as to support the metatarsal area of the foot. See FIG. 9. Alternatively, the midsole 120 may be formed by first 122 and second 130 portions, wherein the first portion 122 is the forefront piece and is preferably flexible, with an upward 124 and downward 126 side that extends from the front toe area 135 of a wearer's foot to the metatarsal area 137 of a wearer's foot, and wherein the second portion 130 is preferably a rigid piece which has an upward 132 and downward 136 side which extends substantially from a metatarsal area 137 of a wearer's foot to a rear area of the foot 139. The flexible first piece 122 may overlap a portion of the second piece 130 to form a hinge area between the first and second pieces, 121, 131 respectively, or the two pieces may be separated as in FIGS. 7–8. The midsole 120 maybe hingedly attached 141 to the cushioning 13, as in FIG. 8. Further, the sole 10 or midsole 120 may comprise a single piece, or may be multiple pieces which are glued or bonded together. In soles or midsoles which have internal air ducts 150, the soles or midsole, may be manufactured by bonding a top plate and a bottom plate together, or alternatively molding a single piece. See FIGS. 15–16. The soles or midsoles with internal air ducts may be made of plastic, rubber, foam, resin, metal, or wood or of other materials known or used by one skilled in the art.

An insole 145 which may be made of textile material such as cotton, felt, linen, polyester, or leather, silicon, or other such materials that one of the ordinary skill of the art uses as insoles may also be placed inside the footwear.

There are a plurality of apertures 50 defined in the sole 10 or midsole 120 and/or insole with or without an orthotic which allows air to flow into and out of air compartment 110 in the heel. The apertures 50 are preferably arranged around the heel 40 portions to provide air flow into the heel 40 portions of the upper 30. The diameter and shape of these apertures 50 will vary from application to application depending on the desired air flow characteristics. In the preferred embodiment, the apertures 50 are circular and have an opening about 10–18 mm from one edge of the aperture 50 to the other corresponding edge. However, the apertures 50 can be reduced in diameter to restrict the flow of air from air compartment 110 and provide a firmer heel 40.

One, or alternatively, several channels 90 may be also located on the upper surface of the sole 10, midsole 120 and/or insole 145, and the channels 90 may be connected in a series. See FIGS. 5 , 6, 16, 18. The apertures 50 are positioned within the channel 90 or channels 90 in order to facilitate the circulation of air in the channels 90 which can be located in various areas of the shoe to circulate air within the footwear. When the heel 40 and support member 85 are compressed, air is expelled from the air compartment 110 in the heel through the apertures 50 and into the upper 30, air also travels into the channel 90 or channels 90. Conversely, when force is removed from the support member 85 and heel 40, a vacuum is created which draws air into the air compartment 110 in the heel 40 through the apertures 50 and from the channel 90 or channels 90. The size, location, and number of channels 90 will vary from application to application depending on the shape, design, and/or material which makes up the insole 145 and/or sole 10 or midsole 120, and the design and the material from which the upper 30 is manufactured. Preferably the footwear has at least one U-shaped channel 90 as shown in FIG. 9.

The heel 40 can be integral with the sole such as in a molded construction, or securably or hingedly attached such as in heat and/or glue bonding. Preferably, however, the heel 40 is removably attached to the bottom side 16 of the sole or midsole, which allows the heel 40 to be changed or interchanged to for example, change the style of footwear, or to replace the heel 40 when it becomes worn. See, e.g., FIGS. 2, 4. The heel 40 can be attached to the sole 10 or midsole 120 in a variety of ways, such as by a stud and aperture connection, Velcro®, fasteners, adhesives, magnets, a wedge and aperture connection, a screw, a bolt, a hinge, a staple, a nut, glue, studs, snaps, wedges, or the like, and a combination thereof. The inside bottom of the heel 40 may also be attached directly to the bottom end or bottom of the support member 85 which is mounted to the sole or midsole, as in FIGS. 1, 10, 14.

As in FIGS. 2–4, 8, 10, 14, 15, 17, the heel 40 may be formed by sidewalls 43 and a bottom plate 46 which serves at the wear surface, and may be shaped and/or textured as desired, for example, to provide a gripping or non-slip surface, and may be provided with cleats, lugs, ribs or other tread patterns. The sidewalls of the heel 40 may be formed by any type of non-porous, flexible material and is preferably made of rubber or a composite thereof which will keep the air from escaping from the sidewalls, and which will withstand repeated compression and expansion. Further, the sidewalls 43 preferably have a series of ridges 44*a* and folds 44*b* in an accordion-like manner, which enables the heel 40 to compress and expand during use without putting undue stress upon the sidewalls of the heel 40. See FIG. 2. Or alternatively, the heel may be formed by concentric, telescoping wall members which are rigid and also prevent the air from escaping from sidewalls 43. This heel is also mounted to the underside of a rigid or semi-rigid sole or midsole by a mounting appliance 170 typically attached to the support member.

Figure 2:
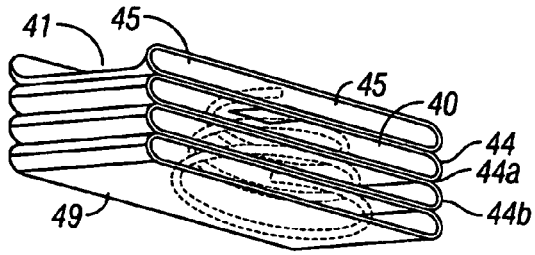
FIG. 2 is a side view of the heel having sidewalls and a bottom plate.
Figure 3:
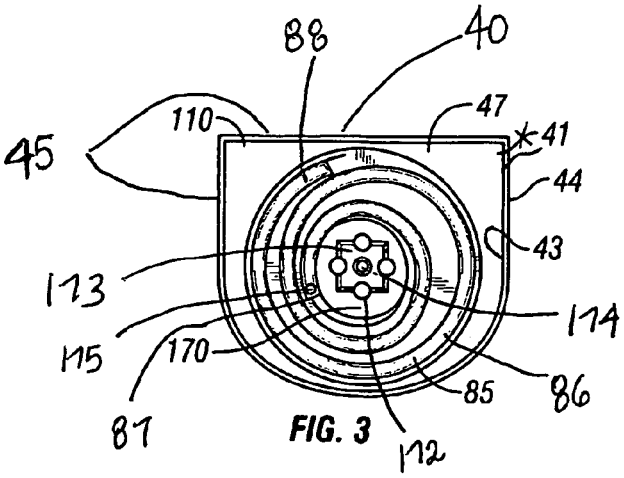
FIG. 3 is an upper view of an unattached heel having sidewalls, a support member, and a bottom plate.
Figure 4:
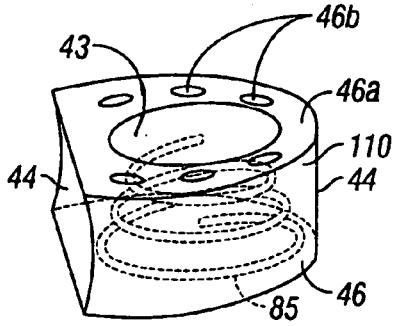
FIG. 4 is a side view of the heel having sidewalls, a bottom plate, a top plate, and a support member.
Figure 6:
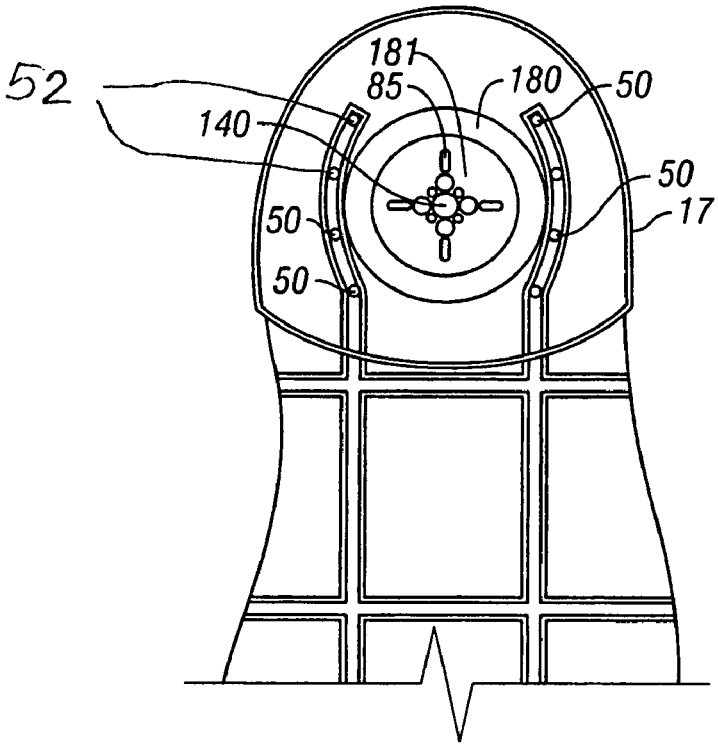
FIG. 6 is a bottom view of a sole or midsole with apertures, a heel skirt, and a mounting platform.
Figure 5:
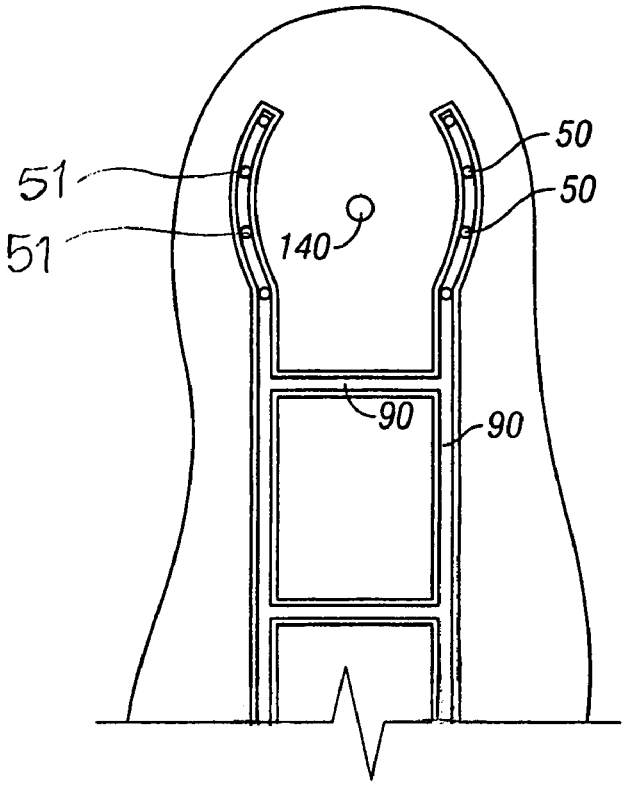
FIG. 5 is a top view of a sole or midsole with apertures and venting channels.

The top edge 41 of the heel 40 may be entirely opened or uncovered which allows the heel 40 to be removably attached to the sole or midsole 120 as in FIG. 2. Conversely, the heel 40 may be self-contained and also have a top plate 46*a*, in addition to sidewalls 43 and a bottom plate 46. See FIG. 4. The top plate 46*a* also would include a plurality of openings 46*b* in the top plate 46*a* which communicate with the apertures 50, 50 in the sole or midsole 120. In this variation, the top plate would also include means to mount the heel 40 to the sole or midsole 120, such as the preferable mounting appliance 170, see FIGS. 10–11. Further, for functional or aesthetic purposes the underside of the sole or midsole 120 may have a skirt 17 mounted with the bottom side of the sole or midsole 120 which extends around just the edges or alternatively, the periphery of the heel 40 portion of the sole or midsole and the heel 40 has a rim 45 at the uppermost edge of the sidewalls 43. See FIGS. 1, 6. In an embodiment wherein the heel 40 lacks a top plate 46*a*, the top edge 41 of the heel is open or uncovered and, the heel rim 45 is placed within the skirt 17 and forms a gasket-like seal.

The footwear preferably has a mounting appliance 170 attached to the first end 87 of the spring 86, and the inside bottom portion of the heel is also preferably attached to the second end 88 of the spring 86. See FIGS. 9–10. The mounting appliance 170 is then removably or securably attached to underside of the sole 10 or midsole 120, which is preferably rigid. The sole 10 or midsole 120 may also have a modified area, such as a platform 180 with a spacer 181 to which the mounting appliance 170 is attached. See FIGS. 6, 12–13. The mounting appliance 170 may have a variety of forms, but preferably, it has a base with a plurality of protrusions 172 which fit into or matingly engage a complimentary geometrically shaped blind space 172*a* in the bottom side of the spacer 181. The protrusions 172 are molded into the top of the mounting appliance 170 and are spaced around a nut 173 with a central threaded hole 174. See FIGS. 3, 10–11. The bolt 186 is installed through a bolt hole 140 in the sole 10 or midsole 120 and threadingly engaged into the threaded hole 174 of the mounting appliance 170. Near the first end of the spring 87, a stabilizer pin 175 may be mounted which fits into the stabilizer holes 185 in the spacer 181 which prevents the heel from rotating, unscrewing, and becoming loosened during wear. See FIGS. 3, 11, 13.

The volume of the air compartment 110 may vary, and the entire heel may be hollow, with the exception of the support member 85. See, e.g., FIGS. 2–4. Further, the relatively large volume of the air compartment 110 in the heel 40 provides ample venting and air circulation within the footwear. The apertures 50 of the sole 10 communicate with the air compartment 110 in the heel 40, and as the wearer steps down on the sole 10 assembly, heel 40 and support member 85 is compressed forcing air out of the air compartment 110 through the apertures 50 in the sole 10 into the upper 30 underneath and around the foot. The sole 10 may also have venting channels 90 in conjunction with the apertures 50 which force air away from the heel 40 toward the front of the shoe. When weight is released from the heel 40, the heel 40 and support member 85 return to their original height and position drawing air back into the air compartment 110. The process repeats itself with each stride.

In the preferred embodiment, the outsole 25, also known as an undersole, is manufactured from a durable, wear resistant material, such as a polyurethane. The lower surface 11 of the outsole 25 forms the wear surface of the completed footwear, along with the bottom outside surface of the heel, e.g., 49 and maybe shaped and/or textured as desired, for example, to provide a gripping or non-slip surface, and may be provided with cleats, lugs, ribs or other tread patterns.

In another aspect of the invention, there are one or several air ducts 150 and there may also be cross ducts 155 which extend through the body of the midsole 120, or alternatively the sole, and are connected to the air compartment in the heel 40 and which connect to or terminate as vents 152 in the midsole 120, or sole. See FIGS. 15–16. The air ducts have at least one first end 151 and at least one second end 153 within the midsole or sole, which communicates with the air compartment 110 at the first end 151 and provides at least one vent 152 in the midsole 120 or sole at the second end 153 which communicates with the upper 30. Preferably, the footwear of this invention has a rigid or semi-rigid sole or midsole 120 in order to prevent a blockage of air flow through the ducts 150 when force is exerted on the sole or midsole 120.

In an alternative variation of the embodiment, the footwear may have a flexible and/or compressible sole or midsole 120 with at least one air chamber 160 within the sole or midsole 120 which has a plurality of passages 161 extending from the air chamber 160 and terminating as air chamber openings 165 into the upper 30 and a compressible member 162 within the air chamber 160. See FIGS. 17–18. If a mounting appliance is used, there is typically a bolt hole 140 in the sole or midsole. See FIGS. 15, 17.

There are a variety of elements which can be used in the air chambers as a compressible member such as pins and corresponding cups, cups and corresponding pockets, resilient lugs, telescoped columns, pistons, compressible wires, and arrangement of opposing strings, bands which straddle the sidewalls, and a combination thereof, or the like that is known or used by one of ordinary skill in the art. For example, there may be an arrangement of pins and pockets, with the same or varying diameters, where the length of each pin is greater than the depth of the corresponding pocket. When the sole or midsole 120 and the air chamber(s) 160 compressible member 162 are compressed by force, such as when the wearer steps down, air is forced out of the air chamber 160 through the air chamber openings 165 which ventilates the upper 30. Conversely, when force is removed and the air chamber 160 begins to recover to an expanded position, a vacuum is created in the air chamber 160 and air is drawn back into the air chamber openings 165 and through the passages 161 into the air chamber 160 when the sole or midsole 120 recovers to an expanded position. The variations of the embodiments with the air chamber(s) 160 may also have channels 90 on the surface of the sole 10 or midsole 120 which further transport the air into other areas of the footwear. Also this footwear may also contain a compressible heel 40 with apertures 50 and/or channels 90 in the sole 10 which vents and directs air to other areas of the foot. When the load is lifted from the sole 10, air is drawn back into the air chamber 160 or chambers 160 within the sole 10 and in the air compartment 110 in footwear with compressible heels 40, negative pressure is created, drawing air back into the heel 40 and restoring the heel 40 to its original height and shape. Additionally, where there are ducts and air vents in the sole 10 or midsole 120, there may also be extended or additional channels 90 and channels of other shapes. See for example, FIG. 16. In certain applications, the air channels 90 can also be eliminated all together and only apertures 50 and vents 152 or apertures 50 and air chamber openings 165 are present in the sole 10, midsole 120, and/or insole 145.

There is also a support member 85 located within the heel 40, preferably within the air compartment 110 which compresses when force such as the wearer's weight is exerted upon the heel 40, and which recovers to an expanded position when the force such as the wearer's weight is removed from the heel 40. The support member 85 is placed between the inner surface 47 of the bottom plate 46 of the heel 40 which serves as the wear surface, and the footwear surface located above the heel 40, such as the bottom surface of the sole 10 or midsole 120. The support member 85 can comprise a variety of elements, made from a variety of materials. Preferably, the support member 85 comprises at least one spring 86, which in the exemplary embodiment is a coil spring 86 with first 87 and second 88 ends, wherein the first end 87 has a smaller diameter than the second end 88. Larger support members 85, such as springs 86 provide greater resistance to deformation and therefore provide the heel 40 portion with the desired resilience. The pattern or location of multiple support members 85 can be altered to control the resiliency of the heel 40. There are a variety of types of support members 85 which could be used in the heel such as pins and corresponding cups, cups and corresponding pockets, resilient lugs, telescoped columns, pistons, compressible wires, and arrangement of opposing strings, bands which straddle the sidewalls, and a combination thereof, or the like that is known or used by one of ordinary skill in the art. For example, there may be an arrangement of pins and pockets, with the same or varying diameters, where the length of each pin is greater than the depth of the corresponding pocket. When a load is exerted on the pin it may deform and/or fill the pocket when subjected to a load.

An insole 145 is preferably disposed into the footwear having a rigid sole 10, midsole 120, or orthotic 28, to make the footwear more comfortable. The insole 145 is preferably made of a resilient and compressible material, such as polyurethane, rubber, and the like although EVA, cloth and other such materials may be used that are known or used by one of ordinary skill in the art. The insole 145 is shaped to fit within the upper 30 and is preferably contoured to provide a comfortable footbed for the wearer. The insole 145 also has a first side which includes a plurality of apertures 50 which communicate with the apertures 50 of the sole 10 or midsole 120, and allow air to flow into and out of air compartment 110 in the heel and/or air chamber 160 of the sole 10 or midsole 120. Apertures 50 communicate with or are aligned with apertures 50, allowing air to flow easily through both insole and any other undercarriage components such as a midsole 120 or sole 10 which are disposed below the insole 145. See, e.g., FIG. 8. Alternatively, the insole 145 can be manufactured from an open, loose weave, or breathable fabric that allows air to pass therethrough without apertures.

Alternatively, and without dismissing the foregoing descriptions and explanations, the footwear may comprise an upper, e.g., 30 having an inside and a bottom side, a lower assembly having a top side and mounted with the bottom side, a heel, e.g., 40 mounted to the lower assembly, a plurality of apertures, e.g., 50 within the lower assembly which extend through the top side of the lower assembly and are located above the heel 40, a support member, e.g., 85 within the heel which compresses and recovers to an expanded position, and a venting means within the sole, e.g., 10 or midsole, e.g., 120 and/or the heel, e.g., 40. In this variety of footwear, the lower assembly may be selected from the group consisting of a sole 10, a midsole 120, an orthotic 28, an outsole 25, means for attaching the lower assembly, and a combination thereof, and any other components, elements, or parts that are commonly known or referred to or incorporated in such lower assemblies. The venting means may be selected from the group consisting of apertures, e.g., 50 in a sole, e.g., 10, at least one air compartment, e.g., 110 within a heel, e.g., 40 which communicates with the apertures 50, at least one channel, e.g., 90 on the surface of the top side of the lower assembly, at least one aperture 50 within a channel 90, a lower assembly having at least one air chamber, e.g., 160, a compressible member 162, e.g., a spring within the air chamber, an aperture, e.g., 50, an air duct, e.g., 150, an air duct, and a combination thereof. The foregoing footwear, may also have means to removably attach the heel to the lower assembly wherein the attaching means is selected form the group consisting of a stud and aperture connection, Velcro®, fasteners, adhesives, magnets, a wedge and aperture connection, a screw, a bolt, a hinge, a staple, a nut, studs, snaps, wedges and a combination thereof, and any other components, elements, or parts that are commonly known or referred to or used to removably attach a heel to a lower assembly. The footwear may further have means for attaching the aforementioned lower assembly to the upper 30 wherein the attaching means is selected form the group consisting of a stud and aperture connection, velcro, fasteners, adhesives, magnets, a wedge and aperture connection, a screw, a bolt, a hinge, a staple, a nut, studs, snaps, wedges, and a combination thereof, or the like that is known or used by one of ordinary skill in the art to attach a lower assembly to an upper, e.g., 30 of footwear. Furthermore, the heel support member may be selected from the group consisting of a spring, pins, cups, pockets, resilient lugs, columns, pistons, wires, strings, bands, and a combination thereof. Also with respect to this footwear, the support member within the heel 40 may be constructed from a material selected from the group consisting of metal, hardened natural rubber, hardened synthetic rubber, metal, reinforced polymers, composite materials, gel, foam, textiles, leather and a combination thereof, or the like that is known or used by one of ordinary skill in the art to construct a support member.

In addition to the various embodiments of the inventive footwear, the invention include a method of providing ventilation in footwear which comprises, forming an upper 30, mounting a sole 10 and/or midsole 120 to the upper, making a plurality of apertures 50 in the sole 10 and/or midsole 120 which communicates with the upper 30, mounting a heel 40 with the sole 10 and/or midsole 120 and/or midsole, providing at least one air compartment 110 within the heel 40 which communicates with the apertures 50 and provides air ventilation to the upper 30, providing a support member 85 within the heel 40 which compresses and recovers to an expanded position, expelling air from the compartment 110 through the apertures 50 when the heel and support member 85 are compressed, drawing air back into the compartment 110 when the heel 40 and support member 85 recover to an expanded position. The method may further include footwear having a heel 40 which removably attaches to the sole 10 and/or midsole 120. The method may also include footwear having at least one channel 90 on the surface of the sole 10 and/or midsole 120 sole, and at least one of the apertures 50 positioned within the channel 90. The method may also include the footwear wherein the heel 40 and support member 85 are compressed and air is expelled from the air compartment 110 through the apertures 50 and into the air channels 90, and wherein the support member 85 and heel 40 recover to an expanded position and air is drawn into the heel 40 through apertures 50 and from the channels 90. The method may also include the foregoing footwear which have a heel 40 which removably attaches to the sole 10 and/or midsole 120.

The present invention is typically manufactured by separately forming the individual components and then assembling them as described below. The outsole 12, also known as an undersole, the sole 10, and/or the midsole 120 are preferably manufactured with conventional molding techniques and apparatus. However, the sole 10 and/or midsole and the insole 145 may also be die cut to shape from the desired materials. The orthotic 28 is also preferably molded as a part of the midsole or otherwise formed using conventional methods. Preferably the sole is made from EVA which provides cushioning, and a rubber undersole with threading is glued to the bottom side of the sole. The upper 30 is then glued to the midsole 120, or the sole if there is no midsole present. In footwear with midsoles, an orthotic is preferably molded into the midsole, and padding and an undersole is attached by glue or other means to the midsole. The support member, which is preferably a spring is glued and/or mold at the second end 88 to a heel 40, and the heel and support member are then attached to the plate of the midsole by a bolt into a washer which is attached to the first end of the spring.

A method is also contemplated by the present invention, generally including the method of providing ventilation in footwear comprising:

forming an upper having a bottom side, mounting a sole and/or midsole to the bottom side, making a plurality of apertures in the sole and/or midsole which communicate with the upper, mounting a heel with the sole and/or midsole, providing at least one air compartment within the heel which communicates with the apertures and provides air ventilation to the upper, providing a support member within the heel which compresses and recovers to an expanded position, expelling air from the compartment through the apertures when the heel and the support member are compressed, and drawing air back into the compartment when the heel and the support member recover to an expanded position. The method may also further comprise a heel which removably attaches to the sole and/or midsole. Alternatively, the method may further comprise at least one channel on the surface of the sole and/or midsole and at least one of the apertures positioned within the channel. In addition to alternative method with at least one channel, the method may further include compression of the heel and the support member which expels air from the compartment through the apertures and into the air channels, and recovery of the support member and heel to an expanded position which draws air into the heel through the apertures and from the channels. Additionally, the heel of this method may be removably attached to the sole and/or midsole.

The above description is that of a preferred embodiments of the invention. Various alterations and changes can be made without departing from the spirit and broader aspects of the invention as defined in the appended claims, which are to be interpreted in accordance with the principles of patent law including the doctrine of equivalents.

What is claimed is:

1. Footwear comprising:

an upper;

a sole having a top side and an underside, wherein said upper is positioned above the sole and secured to the sole;

said sole having a plurality of apertures, wherein the apertures extend through said sole, with each aperture having an opening on the top side and on the underside of the sole;

a heel having sidewalls, a top opening, and a bottom plate, said bottom plate having an inner surface and an outer surface, said sidewalls comprising a flexible material;

at least one compartment for holding air within said heel and enclosed by flexible material of said sidewalls, wherein said at least one compartment communicates with said apertures and provides air ventilation to said upper through said top heel opening when the heel is attached and the heel compartment is compressed; and a compressible support member having a first end and a second end, wherein said support member is placed within said heel, wherein the second end of said support member is attached to the heel, and wherein the first end of said support member is removably or securably attachable to the underside of said sole, and thereby attaches said heel to said sole, said flexible material of said sidewalk bending to permit compression of said heel and said at least one compartment and said compressible support member.

2. The footwear of claim 1, wherein said apertures communicate only between said at least one compartment and said sole and are closed off with respect to any exterior surface of said footwear such that air is expelled from said compartment through said apertures and into said upper when said heel compartment and said support member are compressed and wherein air from said upper is drawn down through said apertures into said compartment as said heel compartment returns to an uncompressed position.

3. The footwear of claim 1, wherein said support member comprises at least one spring, wherein said spring is a coil spring with first and second ends, wherein said first end has a smaller diameter than said second end.

4. The footwear of claim 3, further comprising a mounting appliance on the first end of said spring for attaching said support member to the underside of said sole.

5. The footwear of claim 4, having a blind space in said sole underside which matingly engages said mounting appliance.

6. The footwear of claim 4, where a bolt is used to removably or securably attach said support member to said sole.

7. The footwear of claim 6, where said sole has at least one bolt hole in the heel area of the sole and where the bolt is inserted into said bolt hole and secured to the support member.

8. The footwear of claim 2, wherein said sidewalls comprise material that substantially seals said heel compartment and wherein a vacuum in said heel compartment is created as the heel and support member recover to an uncompressed position.

9. The footwear of claim 1, wherein said support member comprises a plurality of springs.

10. The footwear of claim 1, wherein said at least one support member and wherein said sidewalls being formed in an accordion-like construction give the heel a resiliency, over a range of loads.

11. The footwear of claim 1, wherein said at least one support member has shock absorbing capabilities due to a series of ridges and folds of said sidewalls which lessens stress upon joints and/or feet of a wearer as compared to footwear without a compressible support member.

12. The footwear of claim 1, further comprising a plurality of breathing holes in at least one area of said upper.

13. The footwear of claim 1, wherein said heel sidewalls have an upper edge, said upper edge forming a rim.

14. The footwear of claim 13, further comprising a skirt mounted on the underside of said sole which extends around a heel area of said sole, and wherein the rim of said heel sidewalls is placed within said skirt when said heel is attached.

15. The footwear of claim 1, having a skirt mounted along the edges of the underside of a heel area of said sole, wherein said heel sidewalls are placed inside said skirt when said heel is attached, said sidewalls further comprising non-porous material.

16. Footwear comprising:

an upper;

a sole and/or midsole having a top side and an underside wherein said upper is secured to the sole and/or midsole;

a heel comprised of sidewalls, a top opening, and a bottom, said heel having at least one air compartment, wherein said heel is removably or securably attached to said sole and/or midsole;

at least one air channel on the top surface of said sole and/or midsole;

a plurality of apertures in said sole and/or midsole, wherein each aperture extends through the top side and the bottom side of said sole and/or midsole, and wherein at least one aperture is positioned to open into said at least one said channel;

wherein said at least one compartment communicates with said apertures and is capable of providing air ventilation to said upper when said compartment is compressed, Thereby pushing air out of said compartment and into said upper through said heel opening, said apertures communicating only between said at least one compartment and an interior of said upper and being closed off with respect to any exterior surface of said footwear; and a support member within said heel compartment which is compressible, wherein a portion of said support member is attached to said heel and where another portion of said support member is attached to the sole and/or midsole, thereby attaching said heel to said sole and/or midsole.

17. The footwear of claim 16, said sidewalls being flexible so as to be compressible, wherein air is expelled from said compartment through said apertures and into said at least one air channel when said heel compartment is compressed, and wherein a vacuum is created in said heel air compartment as said compartment recovers to an uncompressed position, thereby drawing air from said upper down into said compartment through said apertures and from said channels.

18. The footwear of claim 16 wherein said support member comprises at least one coiled spring, said spring having a first end and a second end, said first end having a smaller diameter than said second end, and further comprising said sidewalls being formed with ridges and folds.

19. The footwear of claim 18, having a skirt mounted with the bottom side of said sole or midsole which extends around the periphery of the heel area of said sole or midsole, wherein said heel sidewalls are placed inside said skirt when said heel is removably or securely attached to said sole or midsole.

20. The footwear of claim 18, having a mounting appliance attached to said first end of said spring and the heel attached to said second end of said spring.

21. The footwear of claim 16, wherein said plurality of apertures are positioned to open into said air channel.

22. Footwear comprising:

an upper;

a sole having a top side, wherein said upper is secured to said sole;

a heel comprised of sidewalls, a top opening, and a bottom plate, and wherein said heel is removably or securably attached to said sole;

a skirt mounted along the edges of the underside of said sole, wherein said heel sidewalls are placed inside said skirt;

a plurality of apertures in the sole which extend through said top side and the bottom side of said sole, where each aperture has an opening on said top side and said bottom side of said sole;

at least one air compartment disposed within said heel, wherein said at least one compartment communicates with said apertures, where said compartment is capable of providing air ventilation to said upper from said top heel opening through said sole apertures when said air compartment is compressed, plurality of apertures communicating only between said at least one compartment and an interior of said upper and being closed off with respect to any exterior surface of said footwear;

a compressible support member having a top end and a bottom end, wherein said support member is placed within said heel air compartment, where said bottom end is connected to said heel;

a mounting appliance attached to the top end of the support member, wherein said mounting appliance is mounted to the underside of the sole; and wherein said mounting appliance removably attaches said heel to said sole.

23. The footwear of claim 22, wherein a bolt removably or securably attaches said mounting appliance to said sole.

24. The footwear of claim 22, wherein the support member comprises at least one spring.

25. The footwear of claim 24, wherein the support member is constructed from a material selected from the group consisting essentially of metal; hardened natural rubber; hardened synthetic rubber; metal; reinforced polymers; composite materials; gel; foam; textiles; leather; or a combination thereof, said support member being enclosed by said sidewalls, said sidewalls comprising a substantially non-porous, flexible material that flexibly compresses when said support member is compressed.

26. The footwear of claim 22, wherein the sidewalls of said heel are flexible.

27. The footwear of claim 22, wherein said support member comprises at least one spring, and wherein said spring is a coil spring with first and second ends, wherein said first end has a smaller diameter than said second end.

28. The footwear of claim 27, where a mounting appliance is attached to said first end of said spring and where the second end of said spring is attached to the bottom plate of said heel.

29. The footwear of claim 22, further comprising at least on channel on the top surface of said sole, wherein two or more of said plurality of apertures are positioned to open into said air channel.

30. A method of providing ventilation in footwear comprising the steps of:

providing a sole and/or midsole with a top surface and a bottom side;

forming an upper and mounting said upper to said sole and/or midsole;

providing a heel comprised of sidewalls, a top opening, and a bottom plate, wherein said bottom plate has an inner surface and an outer surface, and wherein said heel is removably or securably attached to said sole;

providing flexible sidewalls that are deformable during walking;

making a plurality of apertures in said sole and/or midsole which extend through said top side and the bottom side of said sole and/or midsole, wherein each said aperture has an opening on said top side and said bottom side of said sole;

providing at least one air compartment within said heel which communicates with said apertures and provides air ventilation to said upper through said top heel opening when the heel is deformed;

providing a support member within the compartment of said heel which compresses and recovers to an uncompressed position;

attaching a portion of said support member to said heel;

attaching said heel to said sole and/or midsole by attaching another portion of said support member to said sole and/or midsole;

placing a force on said heel for deforming said sidewalls and at least partially compressing the heel air compartment, thereby displacing air from said compartment through said top heel opening and said apertures into said upper when said heel air compartment is compressed; and removing said force from said heel, thereby drawing air back into said compartment from said upper as said heel air compartment recovers to an uncompressed position.

31. The method of claim 30, further comprising the step of providing at least one channel on the top surface of said sole and/or midsole and positioning at least one of said aperture openings in said at least one channel.

32. The method of claim 30, further comprising the steps of:

providing a wearer having a body weight and having a pair of feet;

placing each said foot within a separate footwear upper and placing the bottom side of each footwear sole and/or midsole and the outer surface of said heel bottom plate upon a surface;

placing the weight of said body upon at least one foot and said footwear; and compressing said heel compartment and support member with the weight force of said body.

33. The method of claim 32, further comprising the steps of:

lifting at least one foot and said footwear off said surface, thereby taking the weight of said body force off said footwear; and allowing the heel compartment to recover to an uncompressed position.

34. The method of claim 33, wherein a vacuum is created as said force is lifted from the footwear and as the compartment returns to an uncompressed position, thereby drawing air from said upper downwardly through said apertures into said air compartment.

35. The method of claim 30, further comprising the steps of:

increasing air circulation in the upper by providing at least one channel on the top surface of said sole or midsole, wherein at least one of said apertures is positioned between said air compartment and said at least one channel; and wherein air circulates in said channel under a foot of a wearer.

36. The method of claim 30, further comprising the steps of:

mounting a skirt on the underside of said sole which extends round a heel area of said sole, and wherein the sidewalls of said heel is placed within said skirt.

37. The method of claim 35, further comprising the steps of:

positioning each top side opening of said plurality of apertures within said at least one channel on the top surface of said sole or midsole.

* * * * *

UNITED STATES PATENT AND TRADEMARK OFFICE

CERTIFICATE OF CORRECTION

PATENT NO. : 7,055,264 B2
APPLICATION NO. : 10/202796
DATED : June 6, 2006
INVENTOR(S) : Alvaro Z. Gallegos It is certified that error appears in the above-identified patent and that said Letters Patent is hereby corrected as shown below:

Column 11, Claim 1, Line 34, delete “sidewalk” and replace with --sidewalls--.

Column 12, Claim 16, Line 45, delete “Thereby” and replace with --thereby--.

Column 13, Claim 22, Line 35, insert --said-- between “compressed,” and “plurality”.

Column 16, Claim 36, Line 6, delete “round” and replace with --around--.

Signed and Sealed this

Seventh Day of November, 2006

JON W. DUDAS
*Director of the United States Patent and Trademark Office*